US005642760A

United States Patent [19]

Arens

[11] Patent Number: 5,642,760

[45] Date of Patent: Jul. 1, 1997

[54] FLANGED TATTING SHUTTLE WITH IMPROVED GRIP

[76] Inventor: Deborah Arens, 13716 NE. 50 Ave., Vancouver, Wash. 98686

[21] Appl. No.: 613,169

[22] Filed: Mar. 8, 1996

[51] Int. Cl.[6] ..... D03D 35/00

[52] U.S. Cl. ..... 139/197; 87/58; 242/52; 139/29

[58] Field of Search ..... 87/58; 342/52; 139/29, 197

[56] References Cited

U.S. PATENT DOCUMENTS

| | | | |
|---|---|---|---|
| 1,127,210 | 7/1915 | Butler | 87/58 |
| 1,521,528 | 12/1924 | Grigg | 87/58 |
| 2,366,568 | 1/1945 | Silliman | 87/58 |
| 2,420,861 | 5/1947 | Carlson | 87/58 |

FOREIGN PATENT DOCUMENTS

| | | | |
|---|---|---|---|
| 747746 | 4/1956 | United Kingdom | 87/58 |

*Primary Examiner*—Andy Falik

*Attorney, Agent, or Firm*—John P. Halvonik

[57] ABSTRACT

A tatting shuttle having upper and lower flanges that extend from the upper and lower surfaces of the shuttle. The flanges impart gripping ability to the user as the fingers are placed inside the area bordered by the flanges. The shuttle comprises a pair of ovoid halves-an upper and a lower half that are connected to one another by a central portion. The central portion is used for holding a length of thread. Each of the halves presents a surface to the user that the fingers and thumb will grip. The flanges extend from the edge of each surface. Those on the upper half extend upwardly and those on the lower half downwardly.

2 Claims, 1 Drawing Sheet

FLANGED TATTING SHUTTLE WITH IMPROVED GRIP

BACKGROUND OF THE INVENTION

1. Field of the Invention

The invention relates to the field of tatting and knitting and in particular to an improved version of the standard shuttle that is used in tatting. Such improvement comprising attaching a flange or lip to those sides of the upper and lower surfaces of the shuttle that are usually held by the tips of the index finger and the thumb. The flanges extend upward and downward so that each finger or thumb fingers will be partially enclosed by the area comprising the surface and the sides of the flanges.

Shuttles are used for tatting and usually comprises a pair of surfaces that are attached to one another. At the front end of the shuttle both surfaces are pointed so as to guide the end of the thread. Tatting is a fine needle work that may be comparable to crocheting and used to create a lace effect. A shuttle is used to align the thread and also serves to keep the reserve thread in constant supply.

It is believed that attaching a flange that extends at a right angle to the upper and lower surface of the shuttle will result in a shuttle that is easier to use and one that will not fall out of the user's fingers. It has been found that when using the standard shuttle for a long time the fingers can become stiff from having to hold the shuttle and the shuttle may be fall out of the hands when one is using the shuttle. The improved shuttle with flanges should not do that as the flanges would abut the sides of the fingers and thus keep the shuttle between the forefinger and thumb.

It is thought that part of the problem is that upper and lower surfaces of the prior art shuttles are flat and that they can easily slip out of the fingers if they are held for a long time. The user in anticipation of this then holds the shuttle with firm grip in order to insure that the shuttle does not slip out of his/her hands. Because the user has to use a firmer grip this may cause the fingers to get cramped and may reduce the ability of the hands to deal with the fine strokes involved. Any time one clenches anything there is bound to be a tradeoff in terms of the ability to make fine movements.

It is believed that by adding flanges that extend around the fingers the ability of the user to hold the shuttle will increase and he/she will not have to hold the shuttle so hard. This will make the shuttle easier to use and the user will feel that is more comfortable in doing the tatting. The added material will prevent the shuttle from falling out of one's hands when in use.

2. Prior Art

While shuttles used for tatting have been in use for some time, there are none known to have flanges in connection with the upper and lower surfaces of the shuttle in order to promote a better grip.

SUMMARY OF THE INVENTION

An improved tatting shuttle having upper and lower flanges that extend from the upper and lower surfaces of the shuttle. The shuttle generally comprises a pair of ovoid surfaces-an upper and a lower half that are connected to one another by a central portion. The central portion is adapted for holding a length of thread. Each of the halves presents a surface to the user that the fingers and thumb will grip. The flanges impart improved gripping ability to the user as the fingers are placed inside the area bordered by the flanges.

The flanges extend from the edge of each surface. Those on the upper half extend upward and those on the lower half will extend downward.

Such gripping portions are believed to improve the grip of the fingers and make the tatting process easier. Both ends of each of the upper and lower surfaces are joined to one another. The central portions of each half are separated from one another and in this space a thread holding portion connects both halves to one another. The front end of each halve if pointed to guide the end of the thread.

It is among the objects of the invention to provide a shuttle for tatting that is easier to hold and produces a more sure grip.

Another objective is to provide a shuttle for tatting that has improved finger and thumb gripping surface having flanges that extend at a right angle to the surface so that it will not wear out as fast and will be easier to hold.

Another objective is to provide a shuttle for tatting having an improved gripping portions that will be easier to hold in the fingers and make such a shuttle easier to use.

Other objectives of the invention will be readily apparent to those skilled in the art once the invention has been described.

DESCRIPTION OF THE PREFERRED EMBODIMENT

Figure 1:
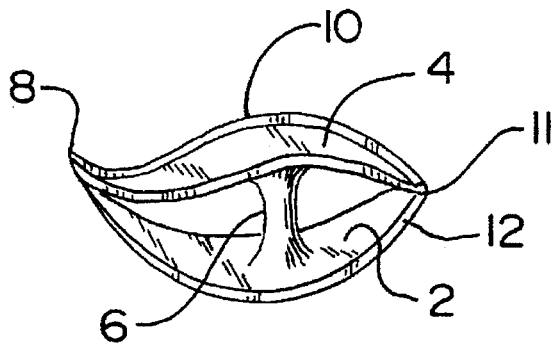
FIG. 1 is a perspective view or the shuttle.

A standard tatting shuttle is constructed as shown in FIG. 1. There is an upper half 4 and a lower half 2. Both pieces are somewhat oval in shape when viewed from above or below. In addition the shape of each curved and may be described as being convex to one another-that is each surface curves away from the other surface when viewed from the side, see FIG. 1.

Figure 2:
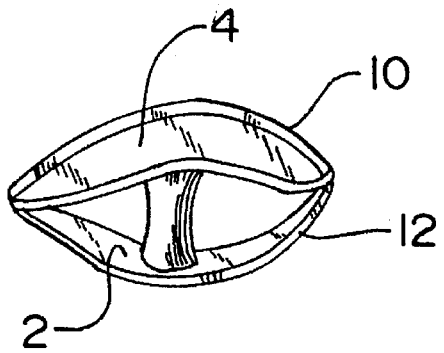
FIG. 2 is a further perspective view.

Part 4 is the upper surface and is generally symmetrical with the lower surface 2. This surface is seen in a better view in FIG. 2. Both the upper and lower surfaces are relatively thin in terms of thickness. One end 8 (may be referred to as the front tip) of each half may be pointed somewhat and may have an aperture for holding the end of the thread that is in use. Each of the two halves are attached to one another near the front and rear tips of each (near numbers 8 and 11) so that the two oval shapes are separated at a distance from one another near the middle of each.

Inside this space there is a portion 6 that connects the middle section of each halve to one another. This portion 6 is used to hold thread that may be wrapped around it. This portion is usually midway between the ends or tips of the ovoid halves.

Such shuttles are usually made of wood, metal, or plastic and all of these materials have some propensity to slide off of the fingers. That is, they do not provide very much friction when they are in contact with the tips of the fingers.

The applicant's invention adds flanges 10 and 12 to those edges of the upper and lower surfaces of the shuttle that are most commonly gripped by the finger and thumb. That flange (10) in connection with the upper surface extends upward from the edge of that surface and preferably goes around the entire edge of that surface so that the tip of the user's finger will be bordered by the upper surface and the flange that extends around this surface.

The lower flange 12 is similar and extends downward from the lower surface 2. Both flanges may be said to extend at a right angle to the surface. See FIG. 2. The material used for the flange is preferably the same as that of the rest of the shuttle so that the entire shuttle may be made of one piece construction. The flanges will extend upward so as to partially enclose the tip of the finger or thumb and thus make it more difficult for the shuttle to fall off of the fingers when in use.

Figure 3:
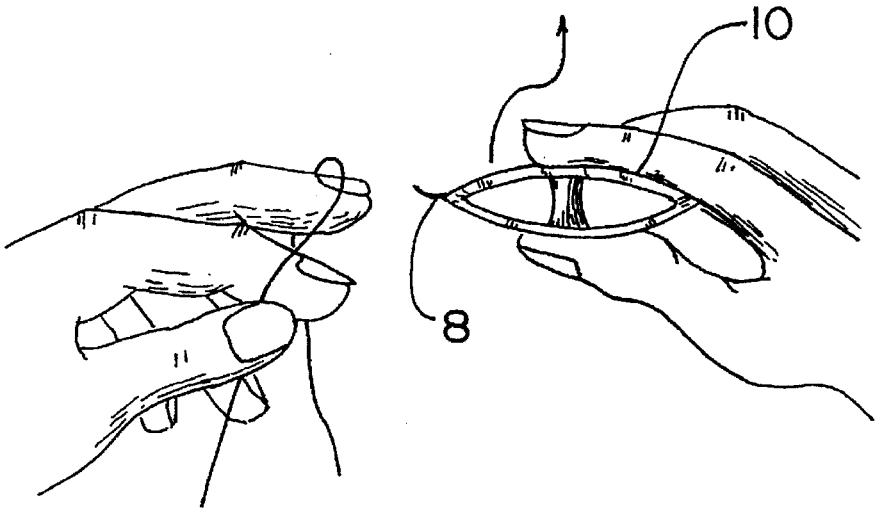
FIG. 3 is a view showing how the shuttle is gripped by a user.

When the shuttle is in use, in FIG. 3 it can be seen that the surfaces are held between the index finger and thumb. The flange 10 will abut the side of the fore finger as the surface 4 comes in contact with the tip of the finger. This will partially enclose the tip of the finger and will keep the shuttle from falling out of the fingers.

The flanges should extend about ⅛" from the surface that they are in connection with. Materials used to construct shuttles e.g. wood, plastic, aluminum, would probably be used for the flanges.

I claim:

1. An improved shuttle for tatting comprising: upper and lower halves, each half having a relatively flat surface and having a front tip, a back tip and a middle portion, a means for holding thread in connection with said upper and lower halves and near said middle portion of each half, each of said flat surfaces having an outer edge extending from said front tip to said back tip, a pair of flanges each in connection with said outer edge so as to form a partially enclosed area between said surfaces, said flanges extending at right angles to said surface whereby, said flanges improve the grip of a user's fingers on said surfaces and make the tatting process easier.

2. The apparatus of claim 1 wherein said flanges are about ⅛" in height.

* * * * *